US005381873A

United States Patent [19]

Kniefel et al.

[11] Patent Number: 5,381,873

[45] Date of Patent: Jan. 17, 1995

[54] PORTABLE RISER UNIT WITH A TELESCOPIC BRACE

[75] Inventors: John H. Kniefel; David R. Boeddeker, both of Owatonna; Glenn G. Kanengieter, deceased, late of Owatonna, all of Minn., by Dorette E. Kanengieter, executrix

[73] Assignee: Wenger Corporation, Owatonna, Minn.

[21] Appl. No.: 129,798

[22] Filed: Sep. 30, 1993

Related U.S. Application Data

[63] Continuation of Ser. No. 818,184, Jan. 8, 1992, abandoned.

[51] Int. Cl.[6] ..... E04H 3/12

[52] U.S. Cl. ..... 182/152; 182/223; 52/9

[58] Field of Search ..... 182/223, 152, 113; 248/354.1; 52/7-9

[56] References Cited

U.S. PATENT DOCUMENTS 2,605,117 7/1952 Hooz et al. ..... 248/354.5 X 3,974,894 8/1976 Wenger et al. ..... 52/9

*Primary Examiner*—Alvin C. Chin-Shue

*Attorney, Agent, or Firm*—Patterson & Keough

[57] ABSTRACT

A portable stepped riser unit for supporting persons or items above a floor, a stage or the like is provided. The riser unit is foldable for transport and storage. It includes a generally tubular support frame, a plurality of platforms for forming the steps removably mounted on the support frame, and a lockable telescoping brace assembly associated with the support frame. The brace assembly includes a foot operated lock, whereby a single operator may fold, move and erect the riser unit.

28 Claims, 10 Drawing Sheets

PORTABLE RISER UNIT WITH A TELESCOPIC BRACE

This application is a continuation of Ser. No. 07/818,184, filed Jan. 8, 1992, abandoned.

TECHNICAL FIELD

The present invention relates to riser units or staging assemblies for institutional use or for use in entertainment for presentations by groups such as choirs, bands or orchestras. More particularly, the present invention relates to a portable riser unit having features which facilitate the storage and safe use thereof.

BACKGROUND OF THE INVENTION

Bleachers, stands and riser assemblies are known in the prior art. U.S. Pat. Nos. 2,598,983 (to Ellis) and 3,2.29,430 (to Berg) disclose risers or staging steps that can be placed in a collapsed position for storage and an erected position for use. However, the disclosed risers do not include features for facilitating or enhancing their portability.

U.S. Pat. Nos. 2,859,488 (to Mackintosh), 3,747,706 (to Paine et al.), and 3,747,708 (to Wenger et al.), the latter two patents being assigned to the assignee of the present invention, relate to portable risers reconfigurable between a transport and storage position and an erect position. The risers have casters or wheels to facilitate their movement.

However, as noted in U.S. Pat. Nos. 3,974,894 and Re. 30,830 (both to Wenger et al. and both assigned to the assignee of the present invention), in each of the three patents noted in the preceding paragraph, it is necessary to turn the entire riser from a position for transport where the casters or wheels engage the floor to a position for being erected and supporting weight. The risers disclosed in the latter two Wenger patents do not require this turning, thereby simplifying their use. The latter two Wenger risers include a latch means to latch the riser in its erected position. The latch means include a hand operated wedging lock for forcing and holding apart a pair of latch rods. For folding the risers, the latch means must be unlocked and held by hand as the riser collapses.

There are at least several problems which have remained unaddressed by the above-noted prior art. When easy portability, including the capacity to be quickly and conveniently rearranged or moved, is a desired attribute for a portable riser, it would be advantageous if a riser unit, including the latching or locking mechanism, could be manipulated as quickly, easily, and conveniently as possible. While the latter two prior art patents disclose a latch means for locking the risers in their erect position, it would be more convenient and efficient if the latch or lock were operable with minimum effort by the person who is moving the risers.

The support frame and safety lock for insuring that a riser stays locked in its erected position during use should be structurally simple, strong, and able to be operated conveniently, thereby minimizing maintenance and the possibility of catastrophic failure. Additionally, the operation of the lock mechanism should be easy to understand and require a minimum amount of manipulation and effort to lock and unlock. It would be desirable that the operator does not have to assume an awkward, uncomfortable, bent-over position or reach beneath the riser to operate the lock by hand. It would also be desirable that the operator is required to manipulate only a single, foot-operated control at one end of the riser, thereby keeping the hands free for other tasks. It would be advantageous if no special tools were required for set up or knockdown of a riser unit.

Clearly, a strong, safe portable riser for entertainment or institutional use that is convenient to move from storage to the point of use, and easy to manipulate into various positions and configurations while in use, would be a decided improvement over the risers disclosed in the prior art.

SUMMARY OF THE INVENTION

In accordance with the present invention, a portable riser unit for supporting persons or items at various heights above a floor, a stage or the like is provided. The riser unit broadly comprises a support frame, a plurality of generally planar and rectangular platform step members, and a telescoping, generally diagonal brace assembly associated with the support frame. The brace assembly includes a lock for locking the riser in its weight supporting position and for controlling the folding of the riser into its storage position.

An object of the present invention is to provide a portable riser unit that is strong, safe and durable, yet may be folded, unfolded and moved easily and conveniently.

Another object of the present invention is to provide a portable riser unit that may be releasably locked into its fully deployed or unfolded position.

Yet another object of the present invention is to provide a portable riser unit, wherein two or more of the riser units may be interconnected to provide adaptable staging arrangements.

A further object of the present invention is to provide a portable riser unit for supporting a plurality of items or persons above a floor, a stage or the like wherein the riser can be deployed or unfolded and folded quickly and easily by a single operator without requiring the use of tools.

An advantage of the present invention is that it may be folded and moved rapidly, whereby it is convenient for use in institutions, for example, in classroom settings, and for entertainment groups such as choirs, bands or the like.

Other advantages of the riser unit of the present invention are that it can be transported to a place of storage very easily by a single person and it occupies a minimum of storage space. The present invention can be moved around easily and it provides for the safe, secure support of persons during use because it includes a lockable brace assembly including a foot-operated lock and safety release. Additionally, the portable riser may be reconfigured for various staging purposes.

Other objects and advantages of the present invention will become more fully apparent and understood with reference to the following specification and to the appended drawings and claims.

DETAILED DESCRIPTION OF THE PREFERRED EMBODIMENT

Figure 1:
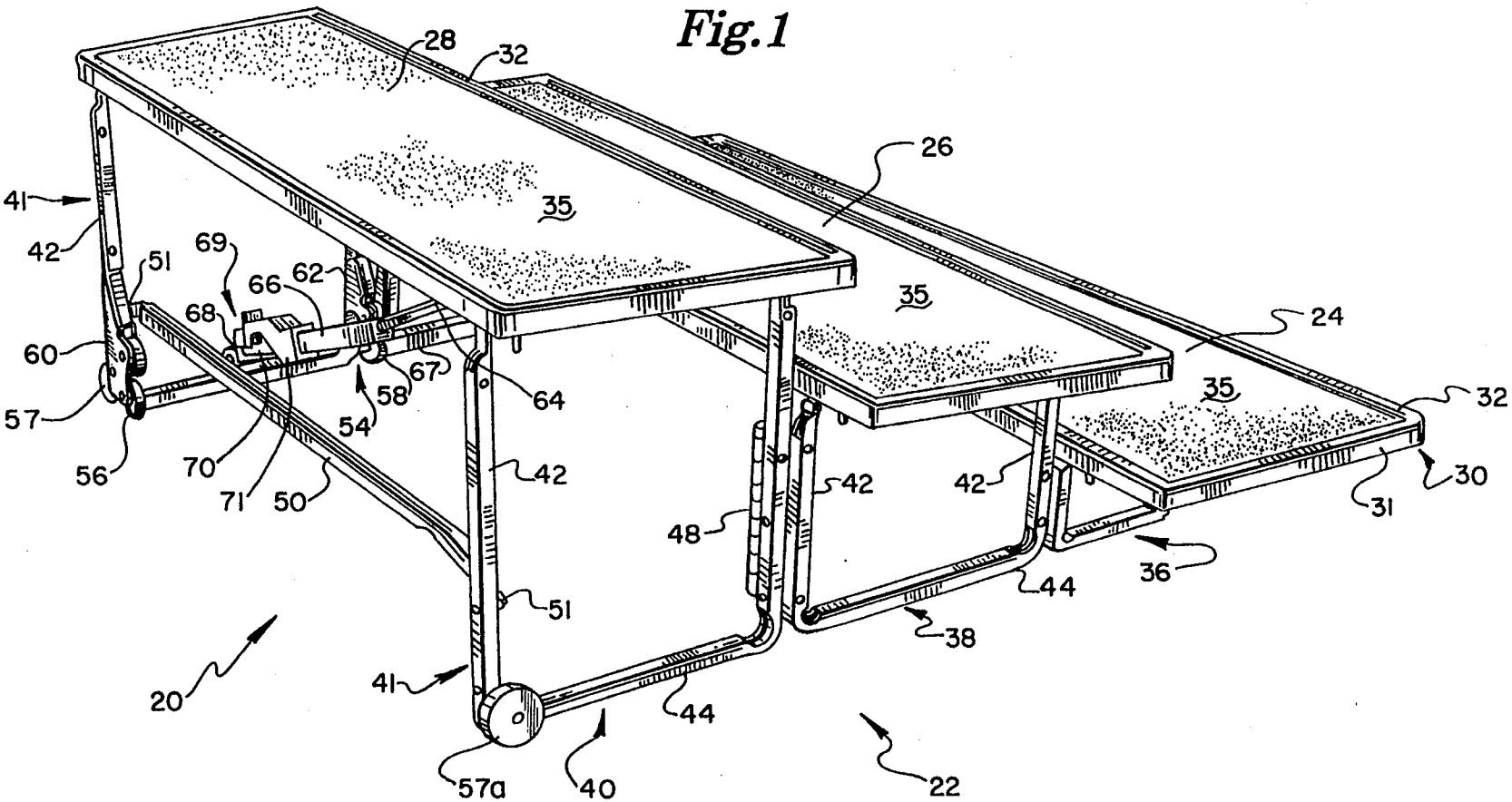
FIG. 1 is a perspective view of the portable riser unit of the present invention fully erected, and ready for use.
Figure 2:
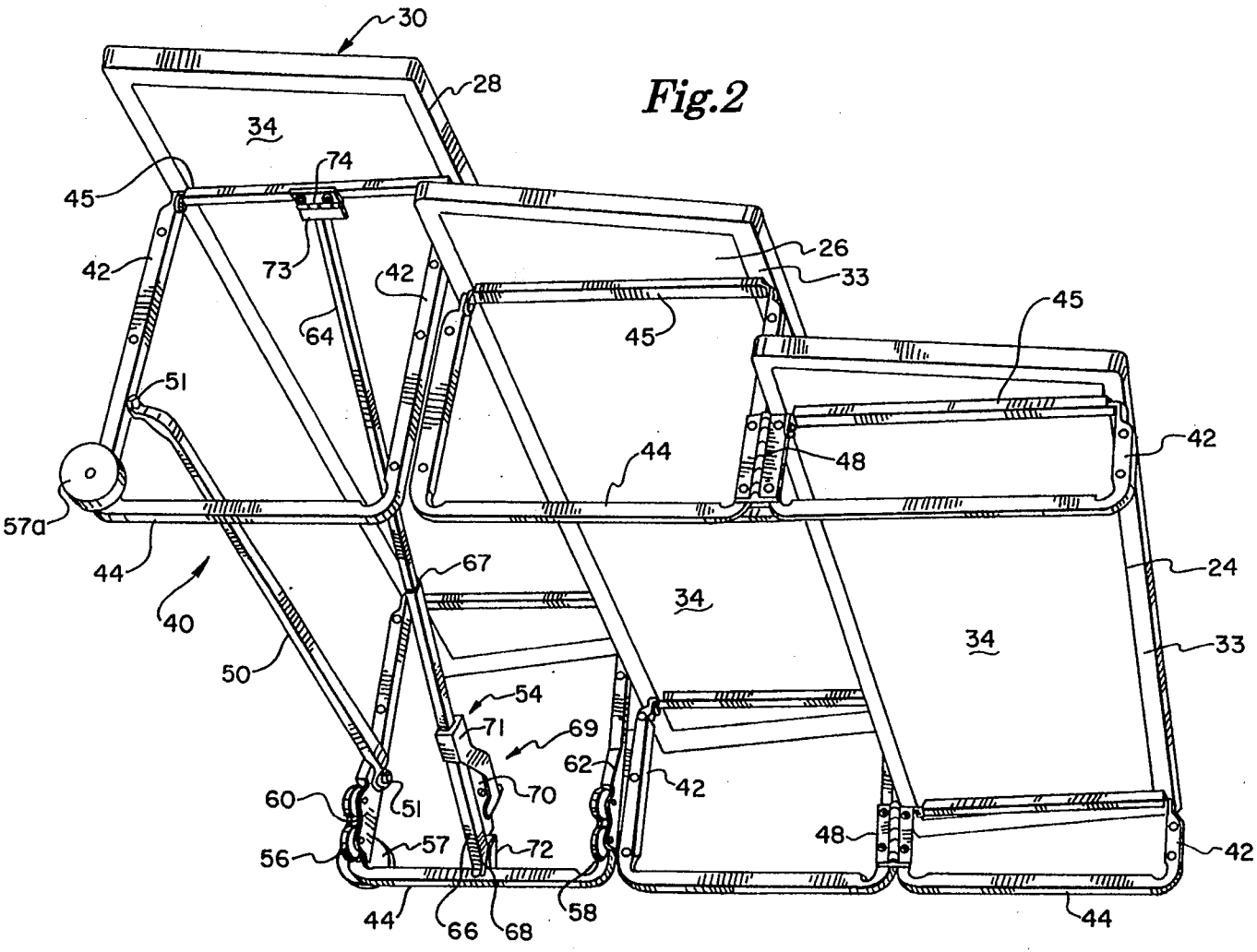
FIG. 2 is a bottom perspective view of the riser unit of the present invention.

With reference to the Figs., particularly FIGS. 1 and 2, the portable stepped riser unit 20 in accordance with the present invention includes a generally tubular support frame assembly 22 and a plurality of individual step-forming platform members including a first, lowest platform 24, second, middle platform 26 and a third upper or highest platform 28. The platform members 24, 26, 28 are supported on the frame 22 whereby, when fully erected for use, they are generally horizontal relative to a floor or stage and lie in generally parallel planes with respect to each other to provide support levels at various distances vertically above the floor or the like.

Each of the platforms 24, 26, 28 broadly includes a generally C-shaped peripheral edge frame member 30 having a generally vertical central web 31 and opposed, generally parallel upper and lower flanges 32, 33, respectively. The flanges 32, 33 are generally perpendicular to the web 31. A relatively thin continuous deck 34, underlying a superficial finish surface 35, is received in the frame 30 and comprises the upper, bearing surface of the individual platforms 24, 26, 28 and the riser 20. The platform members 24, 26, 28, particularly the deck 34, might be formed of wood, wood-by products, suitable plastics or vinyls, or other suitable material.

With regard to the support frame 22, each of the step-forming platforms 24, 26, 28 is supported by a generally discrete support frame cell 36, 38, 40. Together, the cells 36, 38, 40 comprise the support frame 22. Each cell 36, 38, 40 has certain elements in common indicated by common numerals as follows. Opposed, generally parallel U-shaped legs 41 form each end of the cells 36, 38, 40. The legs 41 include a pair of parallel, generally vertical upstanding leg members 42, integrally connected to a floor contacting, straight base 44. The base 44 is generally perpendicular to the leg members 42. With particular reference to FIG. 2, adjacent the uppermost ends of the leg members 42, each frame cell 36, 38, 40, particularly each leg 41, includes a step-contacting, generally U-shaped crossmember 45. The crossmembers 45 are pivotally connected to each leg member 42 adjacent to the upper end thereof and are generally parallel to the bases 44. The upper ends of the U-shaped crossmembers 45 contact the underside of the platforms 24, 26, 28. A pair of apertures are provided in the generally central region of one of the crossmembers 45 of the cell 40 associated with the highest platform 28.

Figures 3, 4, 4A, 5:
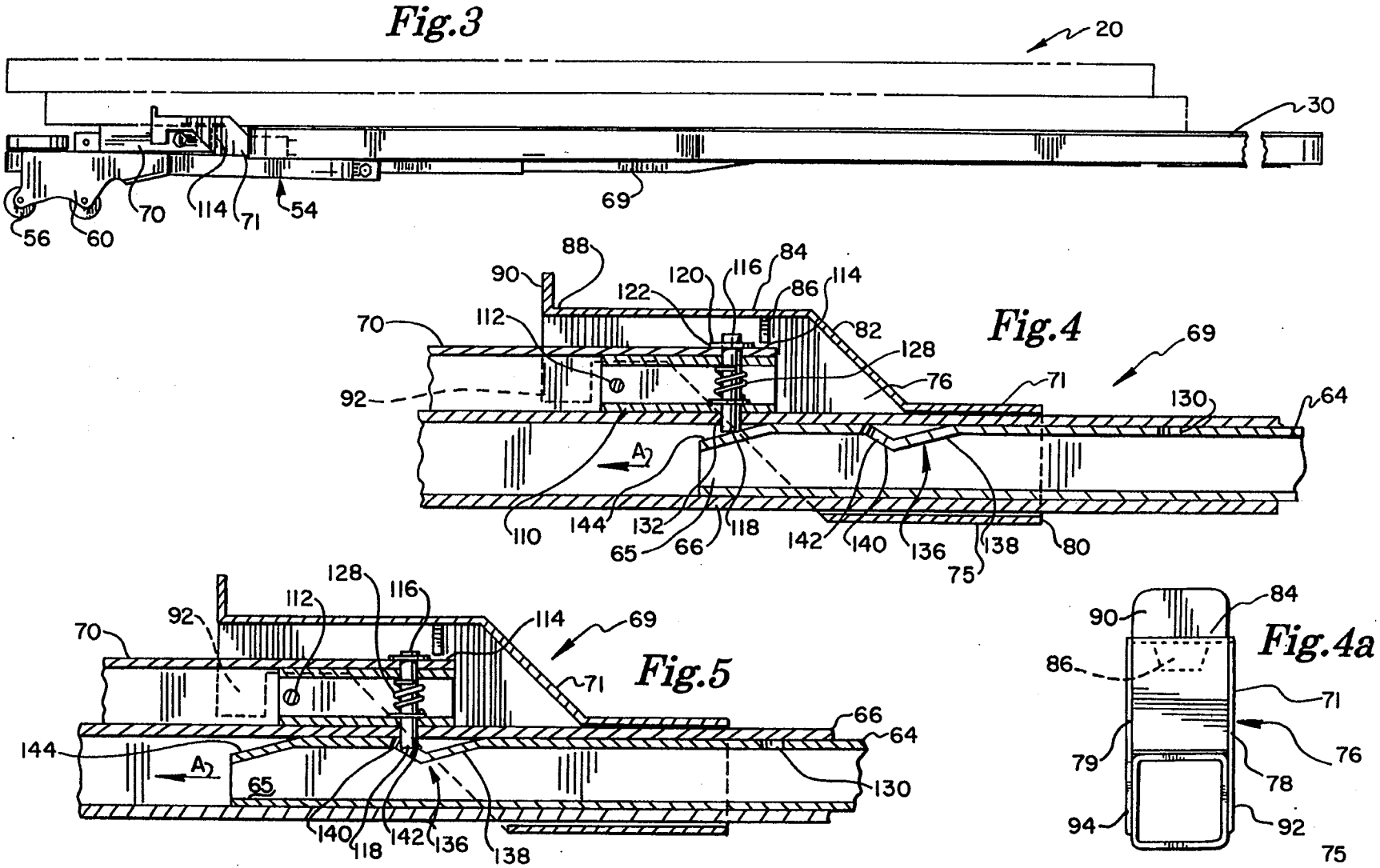
FIG. 3 is a rear elevational view of the present invention folded fully into its storage position.
FIG. 4 is an enlarged fragmentary view of the present invention, more particularly, the extendable brace assembly thereof, in an initial position during the erection of the riser.
FIG. 4*a* a front and elevational view of the safety release mechanism of the present invention.
FIG. 5 is a view somewhat similar to FIG. 4, showing the brace assembly in an intermediate safety-locked position.
Figure 3A:
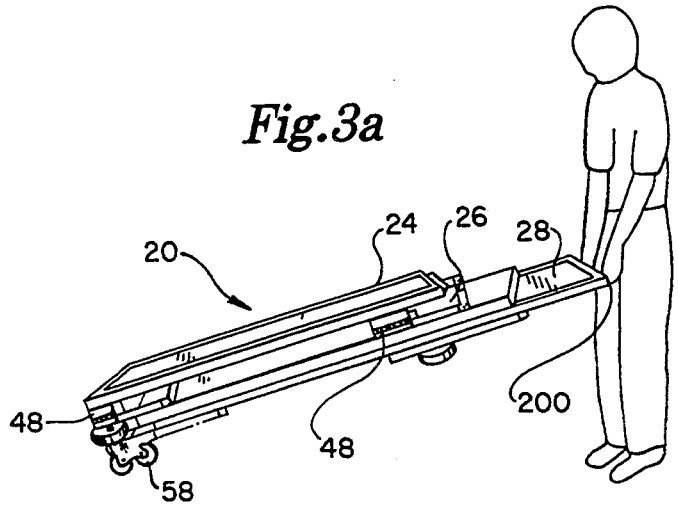
FIG. 3*a* is a pictorial view showing the riser unit being transported.

The frame cells 36, 38, 40 are interconnected by bilateral, substantially identical hinges 48 fixed to adjacent leg members 42. The hinges 48 have hinge leaves wide enough to span a riser platform, whereby the riser platforms may be in superimposed facing relation in the transport and storage positions, as depicted in FIGS. 3 and 3*a*. The hinges 48 may be of the rule joint type, but any suitable structure that provides a pivoting hinge joint may be used to foldably connect cells 36, 38, 40 together into the frame 22.

The support frame cell 40 for the highest platform 28 includes a rigid, generally straight, transverse tie bar 50 pivotally coupled at pivot joints 51 to opposite ends of the cell 40 at upstanding leg members 42. The cell 40 for supporting the highest platform 28 also includes a telescoping diagonal brace assembly 54 and two tandem transport wheel sets 56, 58. The tandem wheels 56, 58 are attached to the upstanding leg members 42 at one end of the cell 40 by transport wheel mounting flanges 60, 62. Further, the wheel sets 56, 58 are a sufficient distance above the base 44 so that when the riser 20 is fully erected (as in FIG. 1), the wheels 56, 58 do not contact the surface the riser 20 is resting on.

The frame cell 40, specifically the rearmost legs 42 thereof, carries a pair of positioning wheels 57, 57*a*. Each of the two wheels 57, 57*a* has an axis of rotation generally perpendicular to the axes of rotation of the tandem wheels 56, 58 and is rotatably attached to its associated leg 42 a sufficient distance above the base 44 so that when the riser 20 is fully erected for use, the wheels 57, 57*a* do not contact the surface the riser 20 is resting on.

Although the support frame cells 36, 38, 40 support the platforms 24, 26, 28, respectively, at various heights above the floor (the four vertically rising leg members 42 of one cell 36, 38, 40 are a different length than the four leg members 42 of another cell) the cells 36, 38, 40 are substantially similar. The transverse tie bar 50 and the brace assembly 54 may be incorporated in any of the cells 36, 38, 40, and more than one tie bar 50 or brace assembly 54 may be used. Preferably, the brace assembly 54 is incorporated in the frame cell 40 associated with the highest step platform 28, whereby the generally diagonal brace 54 is angled to provide maximum support, strength and rigidity when the riser 20 is fully erected. The support frame 22 is generally tubular, being formed from lightweight metallic material such as tubular steel or extruded aluminum, although other suitable materials might be used as well.

Figure 11:
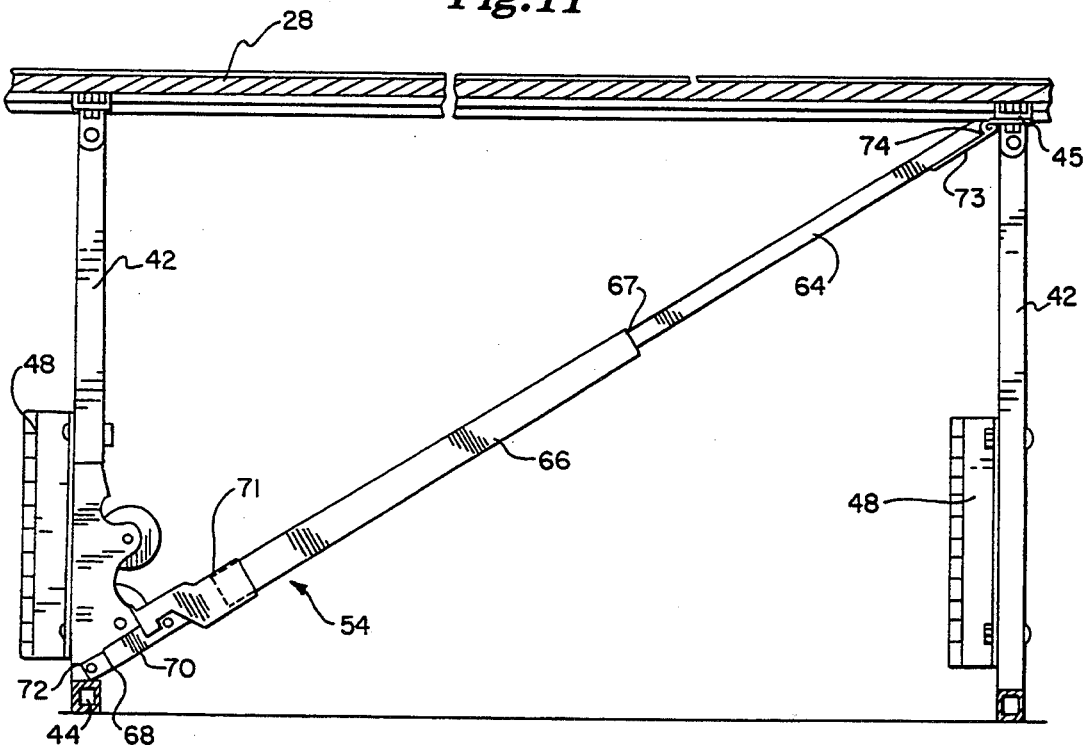
FIG. 11 is a cross-sectional view taken along line 11—11 of FIG. 10.

With continued reference to FIGS. 1 and 2, the telescoping diagonal brace assembly 54 includes an extension strut 64 with a free end 65, a generally tubular sheath 66 and a lock assembly 69, including a rocker 70 and a kick-actuated safety release 71. The sheath 66 has an open end 67 and a closed end 68. The closed end 68 is operably coupled into the cell 40 supporting the highest platform member 28 are a lower sheath pivot joint mounting 72 connected to the generally central area of the base portion 44 at one end of the cell 40. At the opposite end of the brace assembly 54, as shown in FIGS. 2 and 11, the extension strut 64 carries a hinge 73. One leaf or plate of the hinge 73 coupled to the underside of the crossmember 45 at the apertures in the generally central area thereof to provide an upper strut end hinge joint 74.

Figure 6:
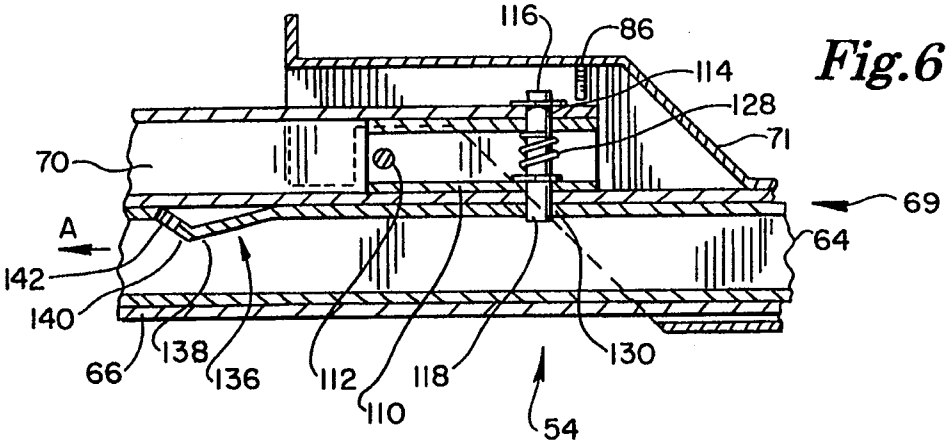
FIG. 6 is a view somewhat similar to FIGS. 4 and 5, showing the brace assembly in the position,it is in when the riser unit is fully erect and ready for use.

FIGS. 4–7 depict the structure and operation of the lock assembly 69. Referring to FIG. 6, the rocker 70 is pivotally connected to a rigid rocker pivot block 110 at a rocker pivot 112. The pivot block 110 is attached to the lower end of the sheath 66 adjacent the pivot joint 72. The rocker 70 and rocker pivot block 110 are drilled to receive and carry a detent pin 114 having a head 116 and foot 118. The pin 114 is retained in place by a typical snap ring retainer 120 and washer 122 adjacent the head 116, and a second typical ring and washer 123, 124, respectively, at the foot 118. A compression spring 128 for biasing the pin 114 into contact with the strut 64 surrounds the shank of the pin 114 within the pivot block 110 and is held in place by the pivot block 110 at one end and the ring 123 and washer 124 at the other end.

The strut 64 and sheath 66 each have registrable detent holes 130, 132. The detent hole 130 in the strut 64 is generally adjacent the free end 65 of the strut 64 received in the sheath 66. Between the strut free end 65 and the detent hole 130, the strut 64 includes a safety catch, indicated generally at 136. The safety catch 136 includes a pair of generally straight ramps, including a first ramp 138 and a second ramp 140. The ramps 138, 140 are angularly related to one another, forming a generally triangular relieved area in the strut 64. The second ramp 140 is shorter than the first ramp 138 and includes a half-latch detent hole 142. The free end 65 of the strut 64 is tapered on at least the upper surface portion thereof to provide a starter ramp 144.

With regard to FIGS. 4 and **4*a*, the single-piece, sliding safety release 71 includes a tubular sleeve 75 and a rocker housing 76. The sleeve 75 is captured between the spaced, parallel side walls 78, 79 at the interior, sleeve end 80 of the housing 76. The housing 76 includes an angled back wall 82 and a top wall 84. A stop tab 86 for contacting the rocker 70 depends perpendicularly from the inside of the top wall 84 adjacent the rear wall 82. At the outermost, second end 88, the release 71, specifically the rocker housing 76, has an upstanding kick plate 90. The kick plate 90 is adjacent the end of the top wall 84, extending outwardly and perpendicularly away therefrom. The second end 88 of the safety release 71 also includes a pair of opposed parallel guide flanges 92, 94. The guide flanges 92, 94 are substantially coplanar with the side walls 78, 79, while the kick plate 90 lies in a plane transverse to the plane of the side walls 78, 79. The guide flanges 92, 94 catch the rocker pivot 112 to control the safety release 71** travel.

Referring to FIG. 4, the strut 64 is depicted moving into the sheath 66 in the direction of arrow A as the riser unit 20 of the present invention is being lifted or erected into its position of use. The starter ramp 144 at the free end 65 of the strut 64 is contacting the foot 118 of the pin 114 and the pin 114 is moved upwardly and outwardly against the bias of the spring 128, but remains in contact with the strut 64.

Referring to FIG. 5, an intermediate relationship between the strut 64 and the sheath 66, and an intermediate step in the folding erection of the riser unit 20, is depicted. In the intermediate position, the detent pin 114 is caught or received in the half-latch hole 142.

Referring to FIG. 6, the strut 64 has moved further in the direction of arrow A to the extent that the pin 114 has been received in the strut detent hole 130. In the position shown in FIG. 6, the telescoping diagonal brace assembly 54 is locked in its fully retracted position to rigidly support the riser unit 20 in its functional, weight-bearing position of use. The stop tab 86 of the release 71 will prevent the rocker 70 from moving enough to withdraw the pin 114 from the hole 130.

Figure 7:
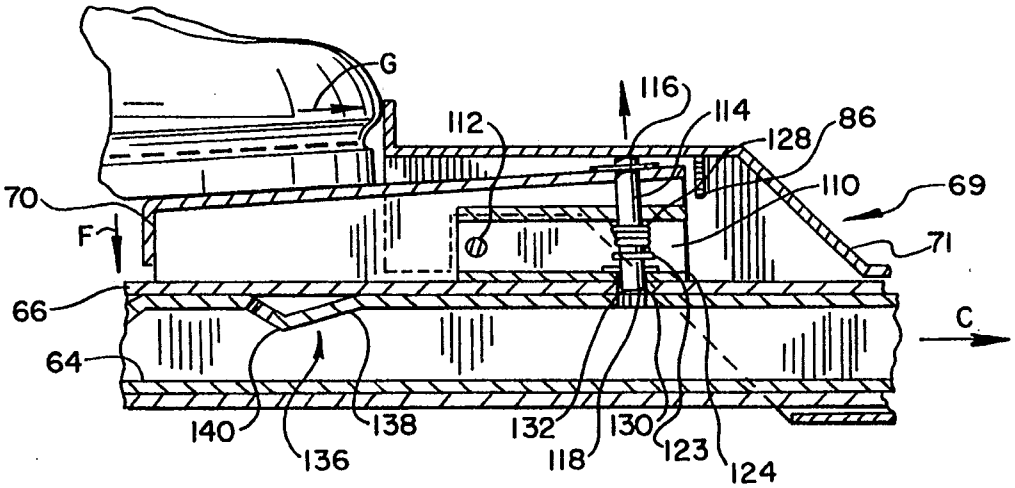
FIG. 7 is a view somewhat similar to FIGS. 4, 5 and 6, showing an operator's foot manipulating the rocker lock of the present invention to unlock the brace assembly from the position depicted in FIG. 6.

Referring to FIG. 7, an operator's foot is shown exerting a force in two directions, first, in the direction of arrow G and against the safety release 71 to move the release 71 up the brace assembly 54 so that the tab 86 clears the rocker 70 and, second, but almost simultaneously, in the direction of arrow F whereby the rocker 70 pivots around rocker pivot 112 to lift the detent pin foot 118 out of the detent hole 130 in the strut 64 against the bias of the compression spring 128. Thus, the strut 64 is freed to move, lengthening in the direction of arrow C as the riser 20 is folded.

FIG. 3 depicts the portable riser unit 20 of the present invention in its fully folded or collapsed position for storage or transport, and FIG. **3*a* depicts the riser unit 20 being transported. The platform members 24, 26, 28 have been folded into close parallel and face-to-face relation about the hinges 48. The portable riser 20 may be moved easily to another location because one or both of the wheels of the tandem transport wheels 56, 58, depending on the riser's angular relation to the surface on which it is resting, are the only structure of the riser 20 that will be in contact with the floor when the opposite end of the riser 20** is lifted.

Figure 1A:
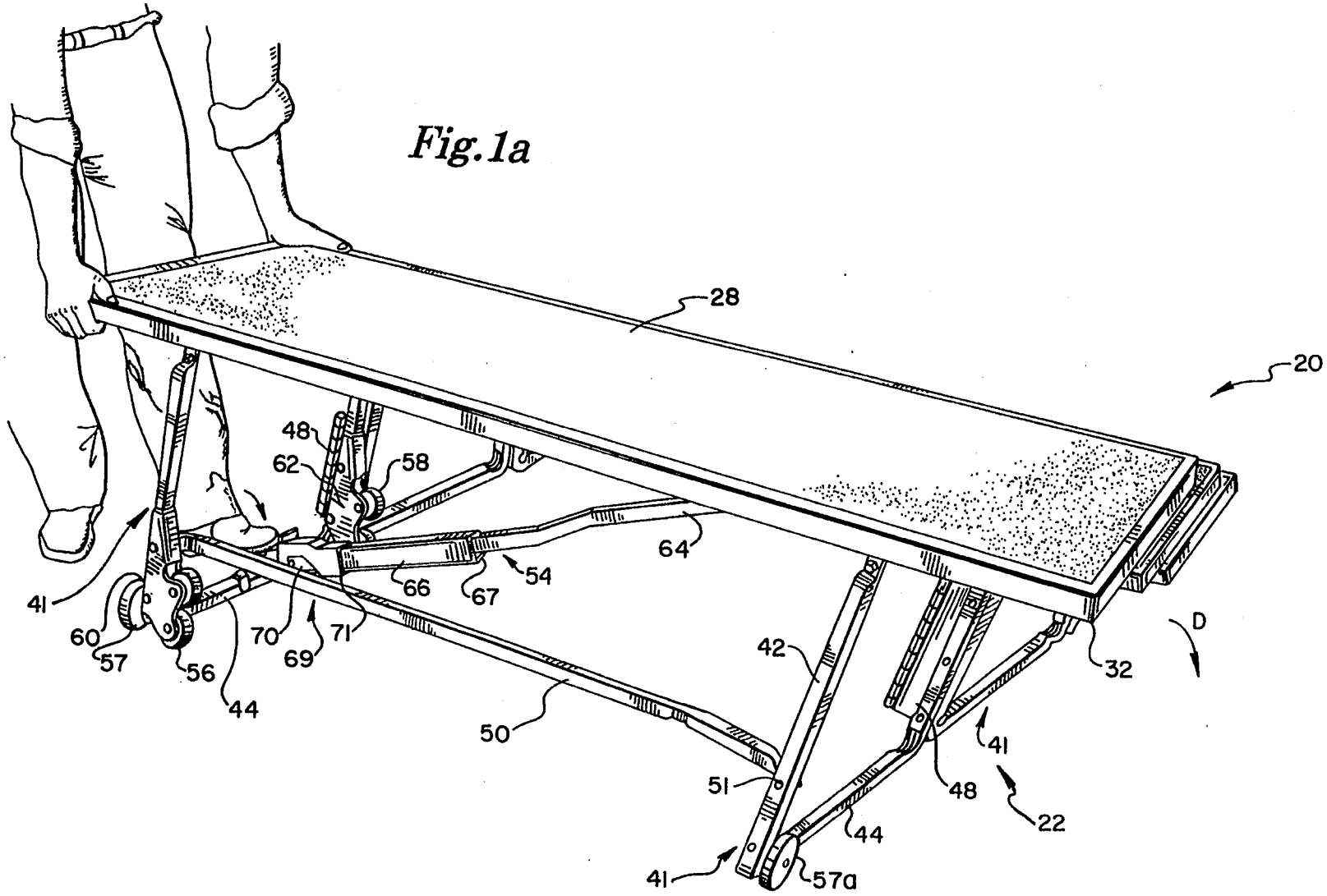
FIG. 1*a* is a perspective view of the riser unit showing an operator manipulating the unit into its folded storage position.

With initial reference to FIG. **1*a*, folding a fully erect riser 20 for transport or storage will be described. Specifically, an operator grips the uppermost platform 28 at or adjacent to its end edge, uses one foot to kick or move the safety release 71 up the brace assembly 54 and, substantially simultaneously, places the same foot upon the rocker 70 to depress it. As depicted in FIG. 7, depressing the outermost end of the rocker 70 raises the detent pin 114 from the strut detent hole 130, and permits the slidable extension of the strut 64 from the sheath 66 in the direction of arrow C. As the riser 20 folds in the direction of arrow D (of FIG. 1*a*), the legs 41 at the opposite ends of the support frame cells 36, 38,**

40 remain parallel. The operator may release the rocker 70 and allow the riser 20 to continue to fold under its weight until the intermediate position depicted in FIG. 5 is reached. The pin 114, biased against the strut 64 by the spring 128, has moved down the first ramp 138, partially up the second ramp 140 and caught in the hole 142, stopping the extension of the strut 64 and, therefore, the folding of the riser unit 20. Thus, the safety catch 136, wherein the detent pin 114 is caught in the detent hole 142, operates to control the collapse of the riser 20. However, continued or newly applied pressure on the rocker 70, following the kick triggering release of the safety release 71, moves the pin 114 out of the hole 142, whereby the pin 114 moves up the second ramp 140 and along the strut 64, allowing continued extension until the end 65 of the strut 64 is past the detent pin 114 and the riser 20 reaches the fully folded position depicted in FIG. 3.

Figure 8:
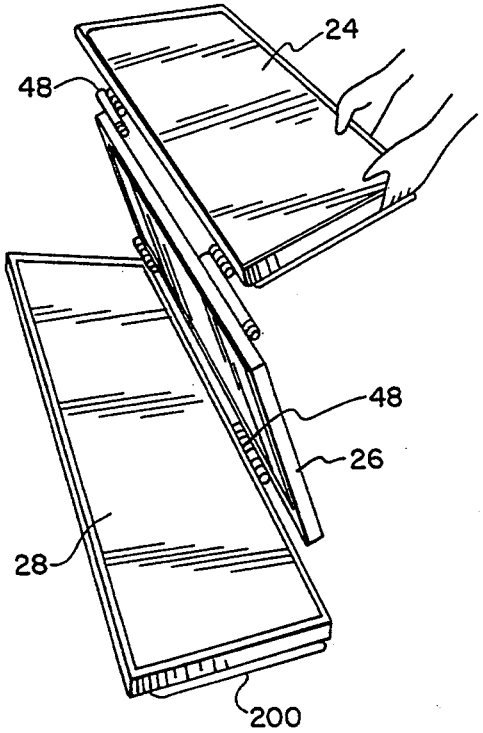
FIG. 8 is a pictorial perspective view depicting an initial step in the erection sequence of the riser of the present invention.
Figure 9:
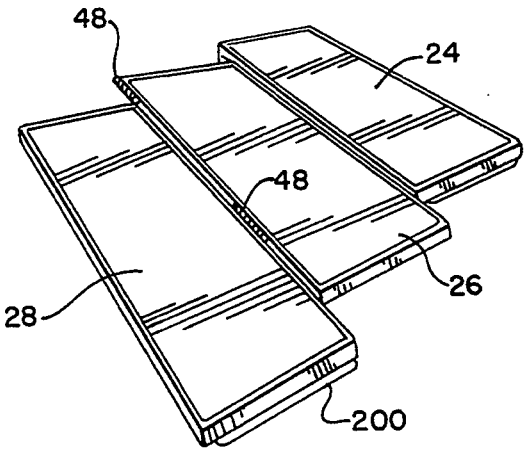
FIG. 9 is a pictorial perspective view depicting a second step in the erection sequence.
Figure 10:
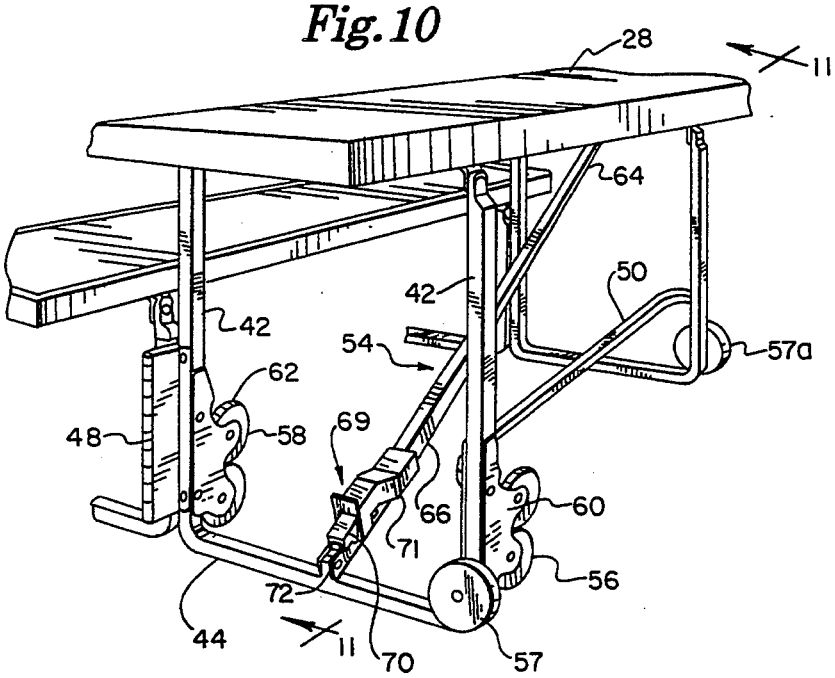
FIG. 10 is a perspective view of the riser depicting the brace assembly fully locked.

To erect or deploy the riser unit 20, the procedure outlined above simply is reversed, with the operator unfolding (see FIG. 8) the platform members 24, 26, 28 from the position depicted in FIG. 3 to the position depicted in FIG. 9, wherein the platforms 24, 26, 28 are generally coplanar and closely adjacent the surface on which they are resting. The operator places one foot against the leg 41, specifically, against the base 44 adjacent the lock mechanism 69 (as shown in FIG. 1 a), grasps the top platform 28 adjacent its end, and lifts it toward himself or herself.

The foot 118 of the detent pin 114 will catch and be lifted by the ramp 144 at the end 65 of the strut 64 as the strut 64 is moving inwardly into the sheath 66 in the direction of arrow A, as depicted in FIG. 4. Once the half-lock safety catch 136 is passed, if the riser 20 begins to slip back to its fully folded state, the pin 114 will automatically engage the half-lock safety catch 136, specifically the half-latch hole 142. As erection or deployment continues, after the safety catch 136 is passed, the spring-loaded detent pin 114 will automatically register with and engage in the detent hole 130 in the strut 64. Thus, the detent pin 114 snaps twice audibly signaling, and giving further assurance, that the riser 20 is fully set up. The safety release 71 slides generally downwardly automatically covering the rocker 70 to prevent the inadvertent operation thereof and the riser assembly 20 will be locked fully upright as depicted in FIG. 1.

An advantage of the present invention is that the tandem wheel sets 56, 58 facilitate the deployment of the riser 20 by changing the lift leverage geometry. Specifically, the wheel of the tandem sets 56, 58 farthest from the base 44 creates a pivot point and a longer effective lever between that wheel and the base 44 of the associated leg 41, compared to the lever created by the closer wheel, thereby increasing the mechanical advantage so the platforms 24, 26, 28 rise upwardly more easily. A sixty percent reduction in the required lift force is achieved.

Another advantage is derived from the positioning wheels 57, 57*a*. To move the riser unit 20 in its fully erected position, an operator simply grasps the lowest platform and raises or tilts the unit 20 until the wheels 57, 57*a* contact the floor. The riser can then be rolled to a new location and the front lowered, whereby the wheels 57, 57*a* are not in contact with the floor and the riser will not move.

Figure 12:
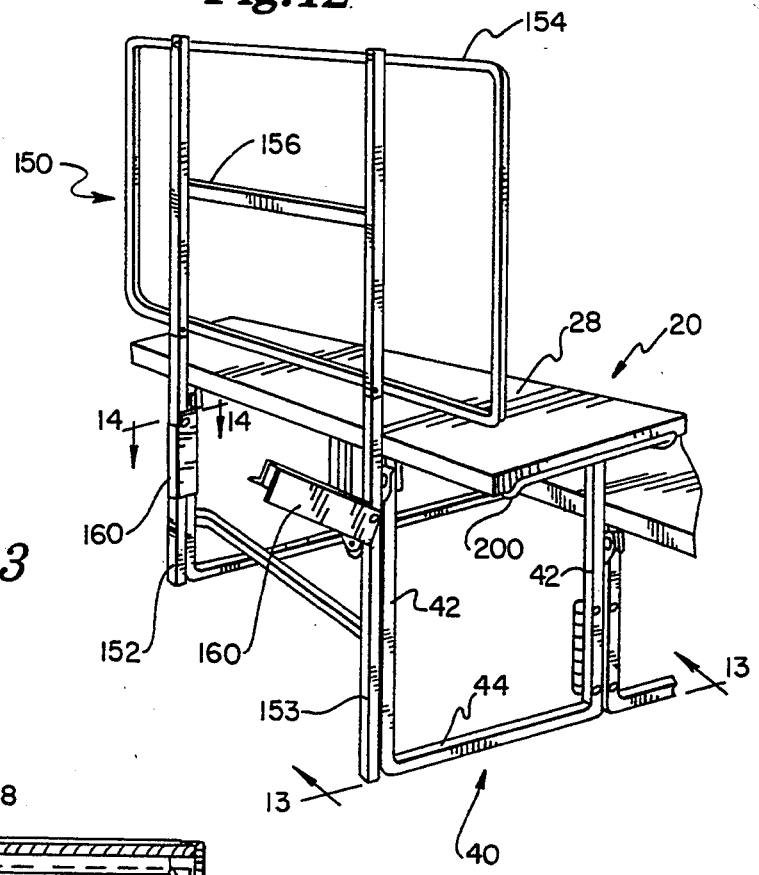
FIG. 12 is a perspective view of the riser depicting a back guard rail mounted thereon.
Figure 13:
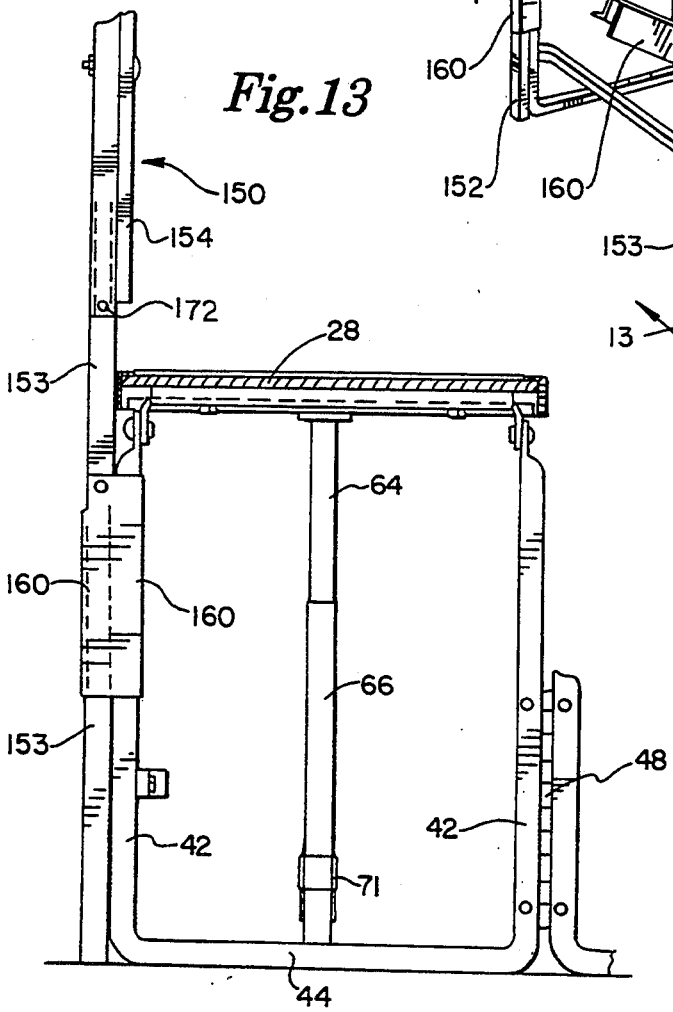
FIG. 13 is an elevational view, partially in section, taken along line 13—13 of FIG. 12.
Figure 14:
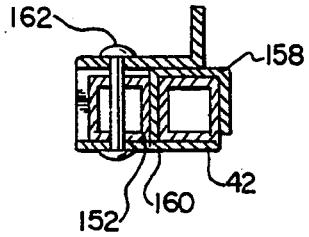
FIG. 14 is cross-sectional view taken along line 14—14 of FIG. 12.

An optional back rail 150 for use with the riser 20 is depicted in FIGS. 12–14. The back rail 150 has a pair of legs 152, 153, an outside guard rail 154, and a central inside crossrail 156. The legs 152, 153 depend downwardly from the guard rail 154 into engagement with the floor, each being adjacent to a leg member 42 of the support cell 40 associated with the highest platform 28. Each of the back rail legs 152, 153 carries attachment means including an elongate vertically extending three-sided bracket 158 which is secured thereto and has an open side to move laterally onto a leg member 42 as shown in FIG. 14. The attachment means for each leg 152, 153 also includes a U-shaped clip 160 pivoted to the leg by a pivot pin 162. The dip 160 is movable from a released position, shown for the clip 160 associated with leg 153 in FIG. 12, to a locked position shown for the clip associated with the leg 152, also in FIG. 12. The bracket 158 locks the respective leg 152, 153 from rearward movement relative to the riser 20 while the clip 160, when moved downwardly into locked relation, holds the parts together and prevents lateral movement.

Figure 15:
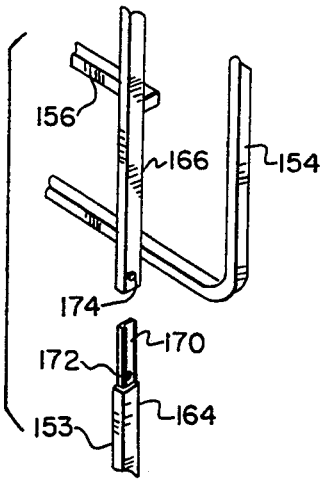
FIG. 15 is a fragmentary perspective view of one of the support legs of the back guard rail for use with the present invention.

With reference to FIGS. 13 and 15, each back rail leg 152, 153 comprises a lower leg member 164 and an upper leg member 166. Above a shoulder 168, the upper end 170 of the lower leg member 164 is tapered or of reduced cross-section with respect to the rest of the leg member 164 and includes a snap lock button 172. The upper member 166, to which the rail 154 is attached, is hollow below the rail 154 to receive the upper end 170 and includes an opening 174 for receiving the button 172. This structure enables the quick, easy installation and removal of the back rail 154, as well as the reversal thereof.

Figure 16:
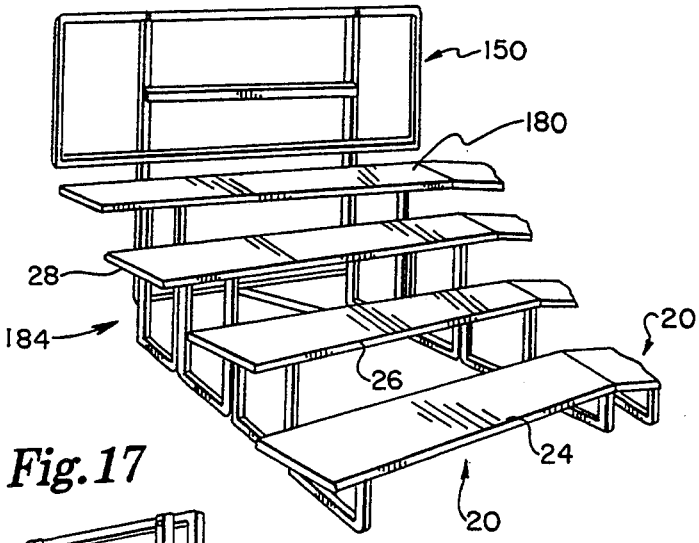
FIG. 16 is a pictorial perspective view depicting two risers of the present invention joined together.
Figure 17:
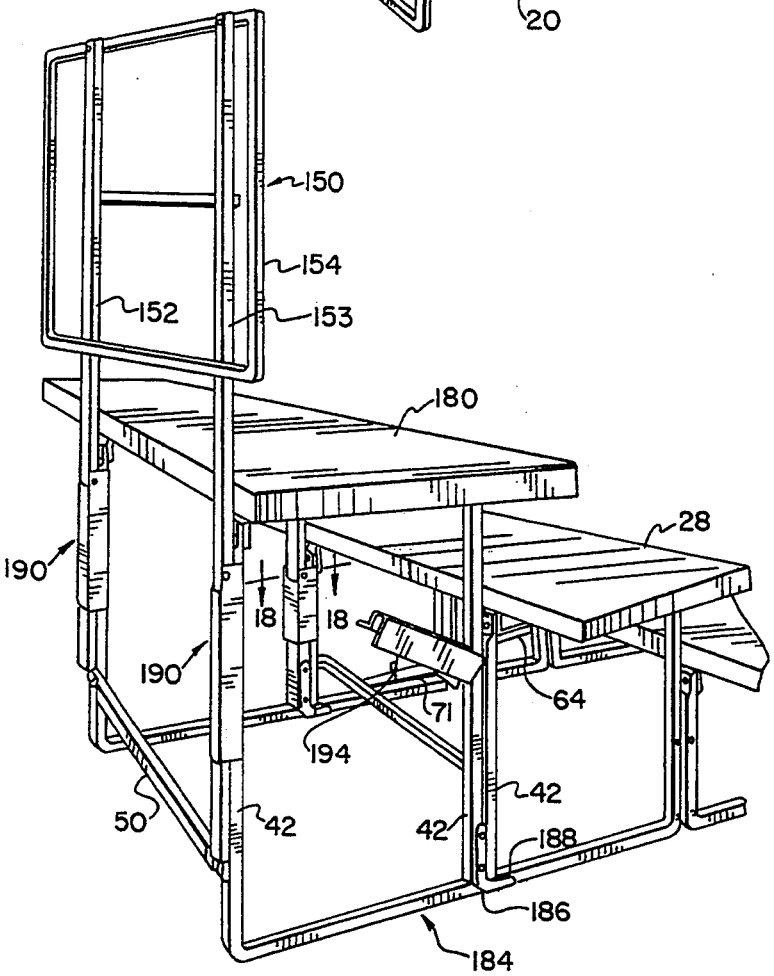
FIG. 17 is a perspective view of the riser of the present invention, including a fourth step-forming platform for optional use therewith.
Figure 18:
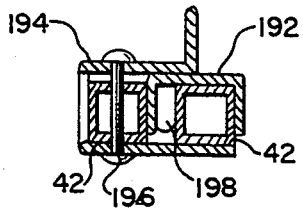
FIG. 18 is a cross-sectional view taken along line 18—18 of FIG. 17.

FIGS. 16–18 depict the portable riser 20 with an optional fourth step-forming platform 180 and with the back guard rail 150. The fourth platform 180 has an associated support cell 184 that is substantially the same as the support cells previously described, but with the leg members 42 having a greater height, placing the fourth platform 180 at a higher level. The platform 180 is connected to the cell 184 in substantially the same way that the other platforms 24, 26, 28 are connected to their associated cells 36, 38, 40. Each of the forward-most leg members 42 of the cell 184 carries a J-shaped bar 186 secured to the lower end thereof, with a part 188 extending forwardly therefrom. Each rear leg 42 carries an attachment structure 190 substantially similar to that described for attaching the back rail 150 to the riser unit 20.

With reference to FIG. 18, the attachment structure for connecting the fourth platform 180 to the riser unit 20 includes an elongate three-sided bracket 192 secured to the leg members 42 and open on one side to laterally fit the leg members 42 of the fourth platform 180, and a U-shaped clip 194 which can be pivotally moved from an open position to the locked position (both positions are shown in FIG. 17) where it spans the leg members 42 of the fourth platform and the brackets 192. The clips 194 are pivoted to the leg members 42 by pivot pins 196. For proper spacing of adjacent leg members 42, spacer plates 198 may be secured within the bracket 192 as depicted in FIG. 18.

To connect the fourth platform 180 to a riser unit 20, the leg members 42 of the fourth platform 180 are positioned at a slight angle from normal thereto. The parts 188 of the bars 186 are placed in engagement with the bases 44 of the support cell 40 of the third highest platform 28. The leg members 42 of the fourth platform 180 are moved to vertical causing the brackets 192 to move laterally onto the leg members 42 of the third platform 28 of the riser unit 20. The U-shaped clips 194 are moved downwardly about their pivot pins 196 to lock the fourth platform 180 to the unit 20.

The back rail 150 depicted in FIGS. 16 and 17 is substantially the same as the rail described above with reference to FIGS. 12 and 13. However, when mounted on the fourth step 180, the lower ends of the legs 152, 153 do not contact the floor, but rest on the tie bar 50 to hold the rail 150 in its proper position. The attachment structure is exactly the same as that described above with reference to FIG. 13.

Figure 19:
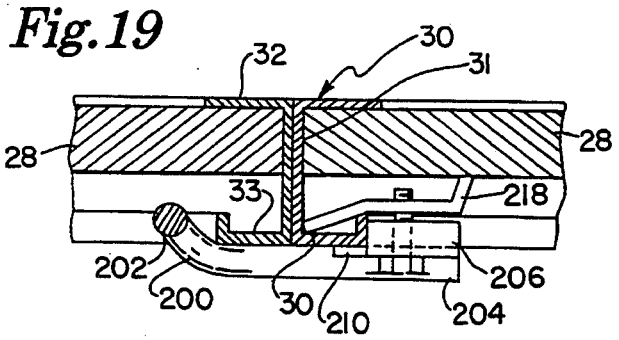
FIG. 19 is a fragmentary sectional view of the riser-to-riser interconnection mechanism, which also serves as a riser transport handle.
Figure 20:
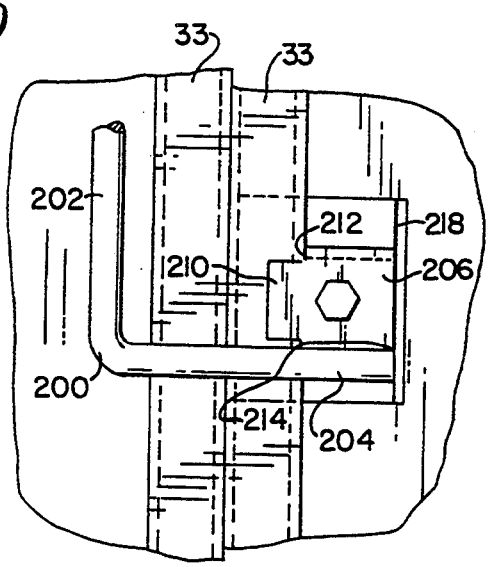
FIG. 20 is a bottom plan view of the interconnection mechanism.

As shown in FIG. 16, two portable riser units 20 may be joined by use of a handle 200 which, as shown in FIG. 3*a*, is also used to facilitate handling of the riser 20 when it is in travel position. The interlocking function of the handle 200 is shown is FIGS. 19 and 20. The handle 200 is in the form of a U-shaped member with an intermediate part 202 and a pair of legs, one of which is shown at 204. The pair of legs extends beneath an end of a platform and the intermediate part 202 lies in spaced parallel relation with the end of the step and beneath the level thereof to engage under the peripheral frame of a step of an adjacent riser. As shown in FIGS. 19, 20 and 7, the handle 200 attached under one platform has an intermediate part 180 beneath the adjacent platform to connect the riser platforms. This interlocking connection is accomplished merely be tipping one unit relative to the other to bring about the interfitting relation shown in FIG. 19. The handles 200 may be positioned on any platform and may be adjusted by means of a releasable clamp structure including a bracket 206 welded to a leg 204 with a flange 210 underlying the frame 30, and a pair of surfaces 212 and 214 abutting against the edge of the frame 30. A bolt passes through an opening in the bracket 206 and is threadably received within a clip 218. Tightening the bolt draws the clip and bracket together in tight relation.

A number of variations of the present invention can be made. For example, the platform members 24, 26, 28 and 180 may be of various shapes. They need not be trapezoidal as depicted, but may be generally rectangular, take the form of other parallelograms, or be in the shape of other geometric plane figures. Likewise, the surface area of the platforms may be varied, their length or width being variable, as long as safety, convenience and portability is maintained. Three or four separated platform step levels are depicted, but any number may be used. The upper surface of the platform members may be covered with carpet, but other appropriate materials may be used as well. The components of the riser unit 20, including the peripheral platform frames, the decking of the platforms, and the riser support frame members might be made from various appropriate materials. Although pin/aperture, rivet-like pivot joints and connections are depicted, other suitable joints providing pivotal motion, such as typical bolt/nut arrangements, may be used as necessary. The upper surface of the platforms 24, 26, 28 might be coated with appropriate substances to impart desirable characteristics such as anti-slip or selected color. The surfaces, platform edges or frame of the present invention may be marked with appropriate indicia to facilitate use and handling. Any number of the portable riser units 20 may be joined and arranged into staging arrangements such as straight, amphitheater and montetheater, as suggested in FIG. 16.

Although a description of the preferred embodiment has been presented, it is contemplated that various changes including those mentioned above, could be made without deviating from the spirit of the present invention. It is therefore desired that the present embodiment be considered in all respects as illustrative, not restrictive, and that reference be made to the appended claims rather than to the foregoing description to indicate the scope of the invention.

What is claimed is:

1. A foot actuated locking brace assembly for a collapsible riser unit having a support frame shiftable through manipulation by the hands and feet of an assembler between a collapsed position and an erected position, comprising:

a telescoping assembly having a first member and a second member selectively, slidably carried by said first member along an extensible path of travel relative to said first member;

foot actuated locking means for selectively locking said second member in position relative to said first member at a predetermined position along said extensible path of travel, including detent means operably carried by said first member for selectively engaging said second member, said detent means including a detent element shiftable between a second member engaging position wherein said detent element operably engages said second member such that said first and second members are locked in position along said extensible path of travel, and a second member clearing position wherein said detent element clears said second member such that said first and second members are shiftable with respect to each other; and a foot engageable actuating member operably coupled to said detent means adapted for shifting said detent element from said second member engaging position to said second member clearing position in response to the engagement of the foot of the assembler with the foot engageable actuating member; and actuating member engaging means for selectively obstructing shifting of said foot engageable actuating member thereby selectively holding said detent element in said second member engaging position.

2. The invention as claimed in claim 1, said telescoping assembly first member comprising a generally tubular element having an upwardly directed surface and said telescoping assembly second member comprising a strut element shiftably received within said tubular element, said foot engageable actuating member comprising a foot engageable rocker plate pivotally operably coupled to said generally tubular element upwardly directed surface.

3. The invention as claimed in claim 2, said rocker plate including a foot receiving end and an opposed end, said rocker plate being operably coupled to said generally tubular element about a rocker plate pivot axis interposed between said foot receiving end and said opposed end, said detent means comprising a detent pin operably carried by said rocker arm at said opposed end.

4. The invention as claimed in claim 3, said detent pin being shiftable between a lowered position and a raised position by the pivoting of said rocker arm about said rocker plate pivot axis in response to the downwardly directed engagement of the foot of the assembler with the foot receiving end of said rocker arm, said lowered and raised positions respectively corresponding to said detent means second member engaging position and said second member clearing position, said detent means including means for biasing said detent pin in said lowered position.

5. The invention as claimed in claim 4, said actuating member engaging means for selectively obstructing shifting of said foot engageable actuating member comprising rocker arm engaging means included in said brace assembly for selectively obstructing pivoting of said rocker arm thereby holding said detent pin in said lowered position.

6. The invention as claimed in claim 5, said rocker arm engaging means comprising a sleeve slidably carried by said telescoping assembly first member, said sleeve including a kick plate engageable by the foot of said assembler for selectively shifting said sleeve along said telescoping assembly first member between a detent pin engaging position wherein said detent pin is held in said lowered position by said sleeve and a detent pin clearing position wherein said sleeve clears said detent pin such that said detent pin is shiftable from said lowered position to said raised position.

7. The invention as claimed in claim 3, said second member strut having an internal end received within said first member generally tubular member and said strut being shifted along a path of travel into said first member generally tubular member as said collapsible riser assembly is raised from said transport position to said erected position, said strut internal end having a generally sloped detent engaging pin surface for engaging said detent pin as said riser is shifted from said transport position to said erected position and shifting said detent pin from said lowered position to said raised position.

8. The invention as claimed in claim 7, said strut including structure defining a first detent receiving aperture spaced from said strut internal end for receiving said detent pin in said detent pin lowered position to lock said first and second members in position along said extensible path of travel when said riser assembly is in said erected position.

9. The invention as claimed in claim 8, said strut including structure defining a second detent receiving aperture interposed between said strut internal end and said detent receiving aperture for receiving said detent pin in said detent pin lowered position along said extensible path of travel when said riser assembly is intermediate said transport and said erected position.

10. A collapsible riser unit shiftable through manipulation by the hands and feet of an assembler between a collapsed transport position and an erected position, comprising:

a support frame having a first portion and a second portion operably, hingedly coupled to said first portion;

a telescoping assembly having a first member operably coupled to said support frame first portion and a second member operably coupled to said support frame second portion, said second member being selectively, slidably carried by said first member along an extensible path of travel relative to said first member;

foot actuated locking means for selectively locking said second member in position relative to said first member at a predetermined position along said extensible path of travel, including detent means operably carried by said first member for selectively engaging said second member, said detent means including a detent element shiftable between a second member engaging position wherein said detent element operably engages said second member such that said first and second members are locked in position along said extensible path of travel, and a second member clearing position wherein said detent element clears said second member such that said first and second members are shiftable with respect to each other; and a foot engageable actuating member operably coupled to said detent means adapted for shifting said detent element from said second member engaging position to said second member clearing position in response to the downwardly directed engagement of the foot of the assembler with the foot engageable actuating member; and actuating member engaging means for selectively obstructing shifting of said foot engageable actuating member thereby selectively holding said detent element in said second member engaging position.

11. The invention as claimed in claim 10, said telescoping assembly first member comprising a generally tubular element having an upwardly directed surface and said telescoping assembly second member comprising a strut element shiftably received within said tubular element, said foot engageable actuating member comprising a foot engageable rocker plate pivotally operably coupled to said generally tubular element upwardly directed surface.

12. The invention as claimed in claim 11, said rocker plate including a foot receiving end and an opposed end, said rocker plate being operably coupled to said generally tubular element about a rocker plate pivot axis interposed between said foot receiving end and said opposed end, said detent means comprising a detent pin operably carried by said rocker arm at said opposed end.

13. The invention as claimed in claim 12, said detent pin being shiftable between a lowered position and a raised position by the pivoting of said rocker arm about said rocker plate pivot axis in response to the downwardly directed engagement of the foot of the assembler with the foot receiving end of said rocker arm, said lowered and raised positions respectively corresponding to said detent means second member engaging position and said second member clearing position, said detent means including means for biasing said detent pin in said lowered position.

14. The invention as claimed in claim 13, said actuating member engaging means for selectively obstructing shifting of said foot engageable actuating member comprising rocker arm engaging means included in said brace assembly for selectively obstructing pivoting of said rocker arm thereby holding said detent pin in said lowered position.

15. The invention as claimed in claim 14, said rocker arm engaging means comprising a sleeve slidably carried by said telescoping assembly first member, said sleeve including a kick plate engageable by the foot of said assembler for selectively shifting said sleeve along said telescoping assembly first member between a detent pin engaging position wherein said detent pin is held in said lowered position by said sleeve and a detent pin clearing position wherein said sleeve clears said detent pin such that said detent pin is shiftable from said lowered position to said raised position.

16. The invention as claimed in claim 12, said second member strut having an internal end received within said first member generally tubular member and said strut being shifted along a path of travel into said first member generally tubular member as said collapsible riser assembly is raised from said transport position to said erected position, said strut internal end having a generally sloped detent engaging pin for engaging said detent pin as said riser is shifted from said transport position to said erected position and shifting said detent pin from said lowered position to said raised position.

17. The invention as claimed in claim 16, said strut including structure defining a first detent receiving aperture spaced from said strut internal end for receiving said detent pin in said detent pin lowered position to lock said first and second members in position along said extensible path of travel when said riser assembly is in said erected position.

18. The invention as claimed in claim 17, said strut including structure defining a second detent receiving aperture interposed between said strut internal end and said detent receiving aperture for receiving said detent pin in said detent pin lowered position along said extensible path of travel when said riser assembly is intermediate said transport and said erected position.

19. A foot actuated locking brace assembly for a collapsible riser unit having a support frame shiftable through manipulation by the hands and feet of an assembler between a collapsed position and an erected position, comprising:

a telescoping assembly having a first member and a second member selectively, slidably carried by said first member along an extensible path of travel relative to said first member, said telescoping assembly first member comprising a generally tubular element having an upwardly directed surface and said telescoping assembly second member comprising a strut element shiftably received within said tubular element; and locking means for selectively locking said second member in position relative to said first member at a predetermined position along said path of travel, including detent means operably carried by said first member for selectively engaging said second member, said detent means including a detent element shiftable between a second member engaging position wherein said detent element operably engages said second member such that said first and second members are locked in position along said extensible path of travel, and a second member clearing position wherein said detent element clears said second member such that said first and second members are shiftable with respect to each other, and a foot engageable actuating member operably coupled to said detent means adapted for shifting said detent element from said second member engaging position to said second member clearing position in response to the engagement of the foot of the assembler with the foot engageable actuating member, said foot engageable actuating member comprising a foot engageable rocker plate pivotally operably coupled to said generally tubular element upwardly directed surface, said rocker plate including a foot receiving end and an opposed end, said rocker plate being operably coupled to said generally tubular element about a rocker plate pivot axis interposed between said foot receiving end and said opposed end, said detent means comprising a detent pin operably carried by said rocker arm at said opposed end, said detent pin being shiftable between a lowered position and a raised position by the pivoting of said rocker arm about said rocker plate pivot axis in response to the downwardly directed engagement of the foot of the assembler with the foot receiving end of said rocker arm, said lowered and raised positions respectively corresponding to said detent means second member engaging position and said second member clearing position, said detent means including means for biasing said detent pin in said lowered position; and rocker arm engaging means for selectively obstructing pivoting of said rocker arm thereby holding said detent pin in said lowered position.

20. The invention as claimed in claim 19, said rocker arm engaging means comprising a sleeve slidably carried by said telescoping assembly first member, said sleeve including a kick plate engageable by the foot of said assembler for selectively shifting said sleeve along said telescoping assembly first member between a detent pin engaging position wherein said detent pin is held in said lowered position by said sleeve and a detent pin clearing position wherein said sleeve clears said detent pin such that said detent pin is shiftable from said lowered position to said raised position.

21. A foot actuated locking brace assembly for a collapsible riser unit having a support frame shiftable through manipulation by the hands and feet of an assembler between a collapsed position and an erected position, comprising:

a telescoping assembly having a first member and a second member selectively, slidably carried by said first member along an extensible path of travel relative to said first member; and locking means for selectively locking said second member in position relative to said first member at a predetermined position along said path of travel, including detent means operably carried by said first member for selectively engaging said second member, said detent means including a detent element shiftable between a second member engaging position wherein said detent element operably engages said second member such that said first and second members are locked in position along said extensible path of travel, and a second member clearing position wherein said detent element clears said second member such that said first and second members are shiftable with respect to each other; and a foot engageable actuating member operably coupled to said detent means adapted for shifting said detent element from said second member engaging position to said second member clearing position in response to the engagement of the foot of the assembler with the foot engageable actuating member, said telescoping assembly first member comprising a generally tubular element having an upwardly directed surface and said telescoping assembly second member comprising a strut element shiftably received within said tubular element, said foot engageable actuating member comprising a foot engageable rocker plate pivotally operably coupled to said generally tubular element upwardly directed surface, said rocker plate including a foot receiving end and an opposed end, said rocker plate being operably coupled to said generally tubular element about a rocker plate pivot axis interposed between said foot receiving end and said opposed end, said detent means comprising a detent pin operably carried by said rocker arm at said opposed end, said second member strut having an internal end received within said first member generally tubular member and said strut being shifted along a path of travel into said first member generally tubular member as said collapsible riser assembly is raised from said transport position to said erected position, said strut internal end having a generally sloped detent engaging pin for engaging said detent pin as said riser is shifted from said transport position to said erected position and shifting said detent pin from said lowered position to said raised position.

22. The invention as claimed in claim 21, said strut including structure defining a first detent receiving aperture spaced from said strut internal end for receiving said detent pin in said detent pin lowered position to lock said first and second members in position along said extensible path of travel when said riser assembly is in said erected position.

23. The invention as claimed in claim 22, said strut including structure defining a second detent receiving aperture interposed between said strut internal end and said detent receiving aperture for receiving said detent pin in said detent pin lowered position along said extensible path of travel when said riser assembly is intermediate said transport and said erected position.

24. A collapsible riser unit shiftable through manipulation by the hands and feet of an assembler between a collapsed position and an erected position, comprising:

a support frame having a first portion and a second portion operably, hingedly coupled to said first portion:

a telescoping assembly having a first member operably coupled to said support frame first portion and a second member operably coupled to said support frame second portion, said second member being selectively, slidably carried by said first member along an extensible path of travel relative to said first member; and locking means for selectively locking said second member in position relative to said first member at a predetermined position along said path of travel, including detent means operably carried by said first member for selectively engaging said second member, said detent means including a detent element shiftable between a second member engaging position wherein said detent element operably engages said second member such that said first and second members are locked in position along said extensible path of travel, and a second member clearing position wherein said detent element clears said second member such that said first and second members are shiftable with respect to each other; and a foot engageable actuating member operably coupled to said detent means adapted for shifting said detent element from said second member engaging position to said second member clearing position in response to the downwardly directed engagement of the foot of the assembler with the foot engageable actuating member, said telescoping assembly first member comprising a generally tubular element having an upwardly directed surface and said telescoping assembly second member comprising a strut element shiftably received within said tubular element, said foot engageable actuating member comprising a foot engageable rocker plate pivotally operably coupled to said generally tubular element upwardly directed surface, said rocker plate including a foot receiving end and an opposed end, said rocker plate being operably coupled to said generally tubular element about a rocker plate pivot axis interposed between said foot receiving end and said opposed end, said detent means comprising a detent pin operably carried by said rocker arm at said opposed end, said detent pin being shiftable between a lowered position and a raised position by the pivoting of said rocker arm about said rocker plate pivot axis in response to the downwardly directed engagement of the foot of the assembler with the foot receiving end of said rocker arm, said lowered and raised positions respectively corresponding to said detent means second member engaging position and said second member clearing position, said detent means including means for biasing said detent pin in said lowered position, said brace assembly including rocker arm engaging means for selectively obstructing pivoting of said rocker arm thereby holding said detent pin in said lowered position.

25. The invention as claimed in claim 24, said rocker arm engaging means comprising a sleeve slidably carried by said telescoping assembly first member, said sleeve including a kick plate engageable by the foot of said assembler for selectively shifting said sleeve along said telescoping assembly first member between a detent pin engaging position wherein said detent pin is held in said lowered position by said sleeve and a detent pin clearing position wherein said sleeve clears said detent pin such that said detent pin is shiftable from said lowered position to said raised position.

26. A collapsible riser unit shiftable through manipulation by the hands and feet of an assembler between a collapsed position and an erected position, comprising:

a support frame having a first portion and a second portion operably, hingedly coupled to said first portion:

a telescoping assembly having a first member operably coupled to said support frame first portion and a second member operably coupled to said support frame second portion, said second member being selectively, slidably carried by said first member along an extensible path of travel relative to said first member; and locking means for selectively locking said second member in position relative to said first member at a predetermined position along said path of travel, including detent means operably carried by said first member for selectively engaging said second member, said detent means including a detent element shiftable between a second member engaging position wherein said detent element operably engages said second member such that said first and second members are locked in position along said extensible path of travel, and a second member clearing position wherein said detent element clears said second member such that said first and second members are shiftable with respect to each other; and a foot engageable actuating member operably coupled to said detent means adapted for shifting said detent element from said second member engaging position to said second member clearing position in response to the downwardly directed engagement of the foot of the assembler with the foot engageable actuating member, said telescoping assembly first member comprising a generally tubular element having an upwardly directed surface and said telescoping assembly second member comprising a strut element shiftably received within said tubular element, said foot engageable actuating member comprising a foot engageable rocker plate pivotally operably coupled to said generally tubular element upwardly directed surface, said rocker plate including a foot receiving end and an opposed end, said rocker plate being operably coupled to said generally tubular element about a rocker plate pivot axis interposed between said foot receiving end and said opposed end, said detent means comprising a detent pin operably carried by said rocker arm at said opposed end, said second member strut having an internal end received within said first member generally tubular member and said strut being shifted along a path of travel into said first member generally tubular member as said collapsible riser assembly is raised from said transport position to said erected position, said strut internal end having a generally sloped detent engaging pin for engaging said detent pin as said riser is shifted from said transport position to said erected position and shifting said detent pin from said lowered position to said raised position.

27. The invention as claimed in claim 26, said strut including structure defining a first detent receiving aperture spaced from said strut internal end for receiving said detent pin in said detent pin lowered position to lock said first and second members in position along said extensible path of travel when said riser assembly is in said erected position.

28. The invention as claimed in claim 27, said strut including structure defining a second detent receiving aperture interposed between said strut internal end and said detent receiving aperture for receiving said detent pin in said detent pin lowered position along said extensible path of travel when said riser assembly is intermediate said transport and said erected position.

* * * * *

UNITED STATES PATENT AND TRADEMARK OFFICE

CERTIFICATE OF CORRECTION

PATENT NO. : 5,381,873

DATED : January 17, 1995

INVENTOR(S) : John H. Kniefel et al.

It is certified that error appears in the above-indentified patent and that said Letters Patent is hereby corrected as shown below:

Column 1, line 19, delete "3,2.29,430" and substitute therefor --3,229,430--.

Column 3, line 9, insert the word "is" between the words "4*a*" and "a".

Column 3, line 15, delete the comma between the words "position" and "it".

Column 5, line 21, delete the word "are" and substitute therefor --at--.

Column 9, line 27, delete the word "be" and substitute therefor --by--.

Signed and Sealed this

Eighteenth Day of July, 1995

*Attest:*

*Attesting Officer*

BRUCE LEHMAN

*Commissioner of Patents and Trademarks*